US005524420A

United States Patent [19]

Ikuta

[11] Patent Number: 5,524,420

[45] Date of Patent: Jun. 11, 1996

[54] HORIZONTAL FORM-FILL-SEAL PACKAGING MACHINE AND METHOD OF CONTROLLING THE SAME

[75] Inventor: Syunya Ikuta, Nagoya, Japan

[73] Assignee: Fuji Machinery Co., Ltd., Nagoya, Japan

[21] Appl. No.: 462,059

[22] Filed: Jun. 5, 1995

[30] Foreign Application Priority Data

Aug. 17, 1994 [JP] Japan ..... 6-193354

[51] Int. Cl.[6] ..... B65B 9/06; B65B 59/02

[52] U.S. Cl. ..... 53/450; 53/479; 53/504; 53/75; 53/550; 53/374.4

[58] Field of Search ..... 53/450, 479, 504, 53/75, 550, 551, 373.7, 374.4

[56] References Cited

U.S. PATENT DOCUMENTS

| | | | |
|---|---|---|---|
| 4,525,977 | 7/1985 | Matt | 53/550 X |
| 4,574,566 | 3/1986 | Eaves et al. | 53/550 X |
| 4,597,240 | 7/1986 | Scully | 53/552 X |
| 4,722,168 | 2/1988 | Heaney | 53/550 X |
| 4,924,657 | 5/1990 | Berti et al. | 53/550 X |
| 4,955,184 | 9/1990 | Francioni | 53/550 X |
| 5,042,229 | 8/1991 | Hirose | 53/504 X |
| 5,138,815 | 8/1992 | Groschen, Jr. | 53/550 X |
| 5,313,766 | 5/1994 | Rimondi et al. | 53/551 X |
| 5,329,745 | 7/1994 | Suga | 53/550 X |

FOREIGN PATENT DOCUMENTS

| | | |
|---|---|---|
| 5134787 | 11/1973 | Japan . |
| 457708 | 2/1992 | Japan . |

*Primary Examiner*—Horace M. Culver
*Attorney, Agent, or Firm*—Palmatier, Sjoquist & Helget

[57] ABSTRACT

A horizontal form-fill-seal packaging machine includes a former for forming a film into a tubular configuration, a conveyor for feeding articles into the tubular film one after another, a fin sealer for sealing lapped edges of the tubular film, an end sealer for sealing the tubular film in a crosswise direction thereof in a position between two adjacent articles, and a film feeding mechanism for feeding the film supplied from a film source into the end sealer via the former and the fin sealer. A plurality of pushers are mounted on the conveyor and equi-distantly spaced from each other in the feeding direction of the articles. Each of the pushers defines the position of a rear end of the article. A length detector sequentially detects the length of the articles in the feeding direction. A controller controls the conveyor and the end sealer in response to the length of each article detected by the length detector. The controller controls the speed of the conveyor such that an equi-distant space is formed between each two adjacent articles. The controller controls the operation timing of the end sealer such that the end sealer seals the tubular film in substantially the central position of the space between two adjacent articles.

14 Claims, 13 Drawing Sheets

HORIZONTAL FORM-FILL-SEAL PACKAGING MACHINE AND METHOD OF CONTROLLING THE SAME

BACKGROUND OF THE INVENTION

1. Field of the Invention

The present invention relates to a horizontal form-fill-seal packaging machine and a method of controlling the same, which permit a continuous packaging of articles having different length and supplied to the machine at random, by varying the package length with the length of each article to be packaged.

2. Description of the Prior Art

A conventional horizontal form-fill-seal packaging machine includes a film supply roll, a former, an article supply conveyor, a fin sealer, and an end sealer. A long thermoplastic film is continuously fed from the film supply roll to the former where the film is formed into a tubular configuration. The article supply conveyor feeds articles into the tubular film one after another. The fin sealer provides a seal in the longitudinal direction of the tubular film at its lapped side edges. The end sealer provides a seal in a crosswise direction of the tubular film on both sides of each article in the longitudinal direction, so that desired packages are formed in succession.

Such a conventional horizontal form-fill-seal packaging machine is disclosed in Japanese Patent Publication No. 51-34787 entitled "Packaging Machine" and Japanese Laid-Open Patent Publication No. 4-57708 entitled "Horizontal Form-Fill-Seal Packaging Machine".

In the "Packaging Machine" disclosed in Japanese Patent Publication No. 51-34787, in order to feed articles into a tubular film with the distance between two adjacent articles automatically adjusted, a first conveying mechanism and a second conveying mechanism are provided in an article feeding section. During the transmission of the articles from the first conveying mechanism to the second conveying mechanism, the articles are fed into the tubular film with the distance between the rear end of each article and the front end of the rearwardly positioned one is adjusted to coincide with a distance between two detectors. In addition, in order to seal the tubular film at a central position between two adjacent articles fed into the tubular film, a sensor is positioned just before an end sealer to detect the rear portion of each article which passes a position besides the sensor, so that the end sealer stopped in a predetermined rotational position is started for rotation. The tubular film is consequently sealed and cut in a position between two adjacent articles which are fed from a supply conveyor to the tubular film at constant intervals.

The "Horizontal Form-Fill-Seal Packaging Machine" disclosed in Japanese Laid-Open Patent Publication No. 4-57708 incorporates, as a supply conveyor for supplying articles to be packaged into a tubular film one after another, a belt-driven supply conveyor which is rotatably driven at a uniform speed. An article detection sensor is disposed on the conveyor to detect the articles for variably controlling the feeding speed of the film as well as the rotational speed of an end sealer, so that the film is fed by an amount in response to the length of each article and so that the crosswise sealing of the tubular film is performed in a central position between each two adjacent articles fed into the tubular film at constant intervals.

With the "Packaging Machine" disclosed in Japanese Patent Publication No. 51-34787, since the machine is repeatedly started and stopped by clutch and brake devices provided in the first and second conveying mechanisms and the end sealer, respectively, the machine involves a disadvantage that it is not suitable for a high-speed operation. Further, because of vibrations which may be produced when the machine is started or stopped, the articles are liable to be moved from their proper positions. Therefore, as disclosed in the description of the preferred embodiment of this publication, it is necessary to hold the articles by upper and lower belts during transportation, causing another problem such as lower productivity and higher manufacturing costs because of complex construction of the whole machine.

Additionally, with this packaging machine, the rotation of the end sealer is started when the rear portion of each article fed into the tubular film is detected by a photoelectric sensor. Therefore, if a film for packaging articles therein is not a transparent one, it is difficult to detect the articles and it is not possible to start rotation of the end sealer.

Further, since the starting of rotation of the end sealer depends only on the detection of the rear portion of each article by the sensor positioned just before the end sealer, no crosswise seal is made in a position forwardly of the article which has been fed at the first time, so that an improper packaging is caused.

On the other hand, with the "Horizontal Form-Fill-Seal Packaging Machine" disclosed in Japanese Laid-Open Patent Publication No. 4-57708, since the feeding speed is varied with change of the length of articles detected by the article detection sensor, the distance between two adjacent articles fed into the tubular film may be varied in response to an instantaneous change in the feeding speed, particularly during a high-speed operation. Further, such change in the film feeding speed may cause unstable lengthwise and crosswise seal of the film, so that the sealing operation cannot be properly performed.

SUMMARY OF THE INVENTION

It is, accordingly, an object of the present invention to provide a horizontal form-fill-seal packaging machine and a method of controlling the same which do not cause an improper sealing or an improper packaging even if articles having different lengths are fed at random to be packaged.

In is another object of the present invention to provide a horizontal form-fill-seal packaging machine and a method of controlling the same which are not influenced by the transparency of a packaging film to be used and which provide excellent pillow packages with package length suitably varied in response to the length of each article fed into the film.

It is a further object of the present invention to provide a horizontal form-fill-seal packaging machine which can reliably package articles without causing any change in positions of the articles during transportation in a high-speed operation.

According to the present invention, there is provided a horizontal form-fill-seal packaging machine comprising:

a former for forming a film supplied from a film source into a tubular configuration with lapped side edges extending in a longitudinal direction of the film;

a conveyor for conveying articles to be packaged and for feeding articles into the tubular film one after another;

a fin sealer for sealing the lapped edges of the tubular film in the longitudinal direction with the articles positioned within the tubular film;

an end sealer for sealing the tubular film in a crosswise direction thereof in a position between two adjacent articles;

a film feeding mechanism for feeding the film supplied from the film source into the end sealer via the former and the fin sealer;

a plurality of pushers mounted on the conveyor and equi-distantly spaced from each other in the feeding direction of the articles, each of the pushers defining the position of a rear end of the article opposite to the feeding direction of the article;

a length detector for sequentially detecting the length in the feeding direction of the articles conveyed by the conveyor; and a controller for controlling the conveyor and the end sealer in response to the length of each article detected by the length detector, the controller controlling the speed of the conveyor such that an equi-distant space is formed between each two adjacent articles, and controlling the operation timing of the end sealer such that the end sealer seals the tubular film in substantially the central position of the space between two adjacent articles.

According to the present invention, there is also provided a method of controlling a horizontal form-fill-seal packaging machine including a former for forming a film supplied from a film source into a tubular configuration with lapped side edges extending in a longitudinal direction of the film, a conveyor for conveying articles to be packaged and for feeding articles into the tubular film one after another, a fin sealer for sealing the lapped edges of the tubular film in the longitudinal direction with the articles positioned within the tubular film, an end sealer for sealing the tubular film in a crosswise direction thereof in a position between two adjacent articles, and film feeding mechanism for feeding the film supplied from the film source into the end sealer via the former and the fin sealer, comprising the steps of:

a) sequentially detecting the length in the feeding direction of the articles conveyed by the conveyor;

b) controlling the speed of the conveyor such that an equi-distant space is formed between each two adjacent articles; and c) controlling the operation timing of the end sealer such that the end sealer seals the tubular film in substantially the central position of the space between two adjacent articles.

With the machine and the method of the present invention, the speed of the conveyor is varied in response to the length of each article, so that the articles are equi-distantly spaced from each other when they are supplied into the tubular film formed by the former. In addition, the driving speed of the end sealer is varied in response to the length of each article, so that the crosswise seal can be performed exactly in the central position between two adjacent articles fed into the tubular film. Further, since the articles are transported by the conveyor with their rear ends supported by the corresponding pushers, the articles do not move relative to the conveyor during transportation in a high-speed operation.

In connection therewith, it is preferable that the length detector is operable to detect the position of the forward end of each of the articles on the conveyor, so that the length of each article can be reliably detected.

Preferably, the controller may normally controls the speed of the conveyor, the feeding speed of the film feeding means and the operation timing of the end sealer to a first reference speed, a second reference speed and a reference timing, respectively, for packaging a reference number per hour of articles having a reference length, and the controller controls the speed of the conveyor and the operation timing of the end sealer to be varied from the first reference speed and the reference timing, respectively, in response to the difference between the detected length of each article and the reference length. Further, when no article has been detected between two adjacent pushers, the controller holds the speed of the conveyor means at the first reference speed and reduces the driving speed of the film feeding mechanism and the end sealer so as to stop the same for preventing production of an empty package.

In case that the end sealer is rotatably driven, the control of the operation timing of the end sealer may be performed on the basis of speed varying control of the rotational speed.

In order to perform the control by the controller, the conveyor, the end sealer and the film feeding mechanism may include motors, particularly servo motors, as drive devices which are independently driven of each other. An encoder is associated with each of the motors and outputs, to the controller, pulse signals representing the rotational position and the speed of the corresponding motor.

The machine may include a pusher position detector and an end sealer position detector. The pusher position detector is operable to detect the current position of each pusher. The end sealer position detector is operable to detect an origin position which is a reference position of rotation of the end sealer. Detecting signals from the pusher position detector and the end sealer position detector as well as a detecting signal from the length detector is inputted to the controller, and the controller outputs control signals to the motors of the conveyor, the end sealer and the film feeding mechanism based on the detecting signals from the detectors.

The invention will become more apparent from the appended claims and the description as it proceeds in connection with the drawings.

DETAILED DESCRIPTION OF THE PREFERRED EMBODIMENT

An embodiment of the present invention will now be explained with reference to the accompanying drawings.

Figure 1:
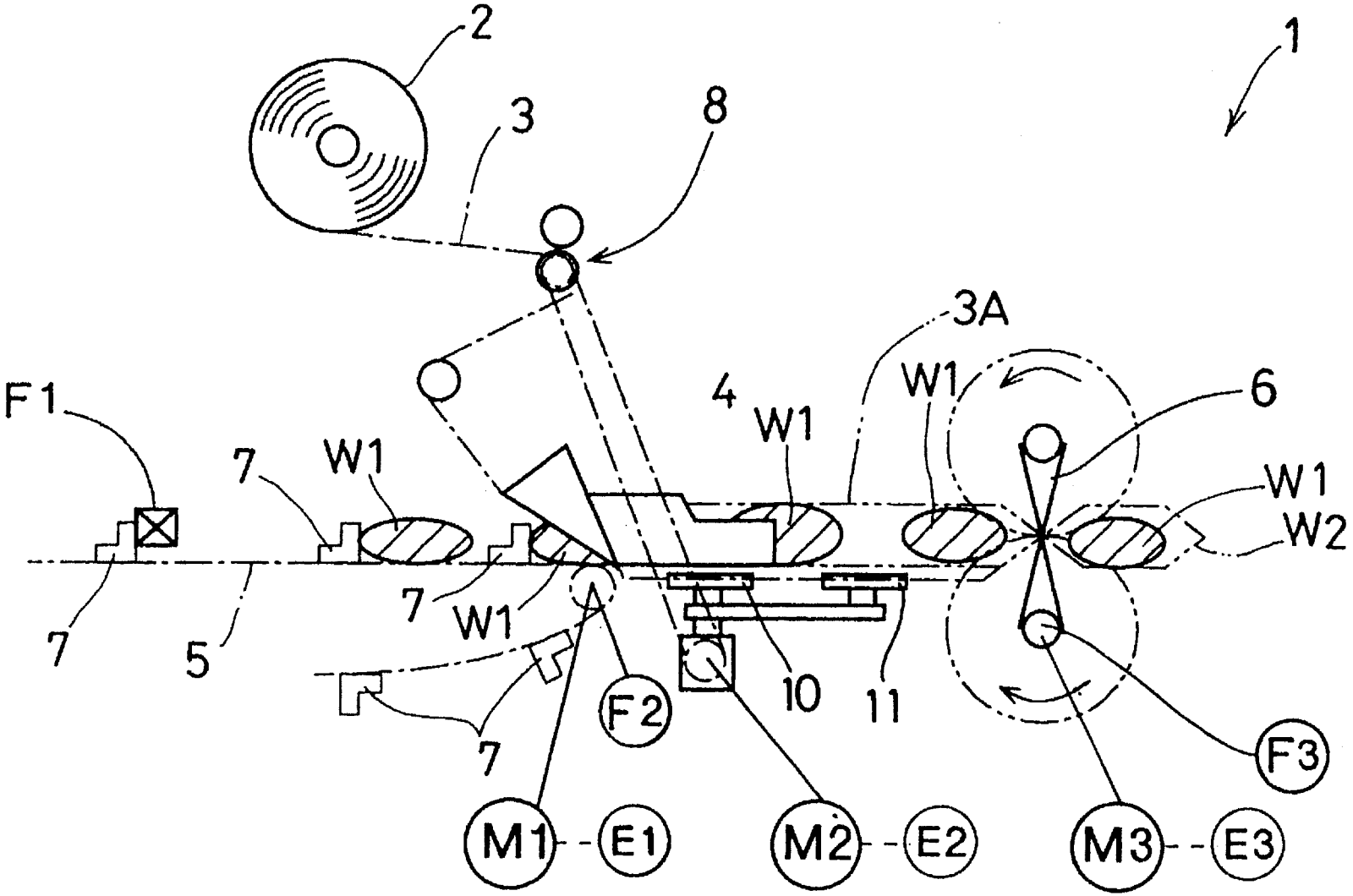
FIG. 1 is a schematic overall view of a horizontal form-fill-seal packaging machine according to an embodiment of the present invention.

Referring to FIG. 1, there is shown a horizontal form-fill-seal-packaging machine 1 in schematic view. The machine 1 includes a former 4, a supply conveyor 5, a pair of seal rollers 11 (only one shown in the drawing) and an end sealer 6. A film 3 fed from a supply roll 2 is formed into a tubular film 3A by the former 4, so that side edges are lapped with each other. The supply conveyor 5 feeds articles W1 into the tubular film 3A one after another. The lapped side edges of the tubular film 3A is sealed in the lengthwise direction of the film 3A by the seal rollers 11. The tubular film 3A is thereafter sealed in the crosswise direction in a position between two adjacent articles W1, so that desired packages W2 are successively formed.

The supply conveyor 5 includes a plurality of pushers 7 mounted on a conveyor belt and extending vertically relative to the conveyor belt. The pushers 7 are equally spaced from each other by a predetermined distance and serve to support rear portions of the articles W1 during transportation. The supply conveyor 5 is driven by a servo motor M1. An encoder E1 is associated with the servo motor M1 for outputting pulse signals in response to a moving position and the speed of the supply conveyor 5.

Here, the supply conveyor 5 is driven at a speed determined on the basis of data relating to a packaging capacity inputted to a controller having a control circuit as will be explained later. Additionally, the speed of the supply conveyor 5 is controlled to be varied with a difference between the length of each article W1 and a reference length obtained from data inputted to the controller. Further, as will be seen from FIG. 1, each pusher 7 mounted on the supply conveyor 5 is inclined downwardly at a position where each article W1 is fed into the tubular film 3A formed by the former 4. Each pusher 7 thereafter recovers its position for supporting a new article W1.

The film 3 wound on the supply roll 2 is fed to the former 4 via a pair of film drawing rollers 8. The lapped side edges of the tubular film 3A formed by the former 4 is nipped between a pair of film feeding rollers 10 (only one shown in the drawing) and is guided by the same forwardly. The seal rollers 11 are disposed adjacent and forwardly of the film feeding rollers 10 so as to seal the lapped side edges of the tubular film 3A in the lengthwise direction. The film drawing rollers 8, the film feeding rollers 10 and the seal rollers 11 constitute a film feeding mechanism and are synchronously driven with each other by a servo motor M2. In a normal operation, the tubular film 3A is fed at a uniform speed or a film feeding speed determined by "film length for reference package length"×"packaging capacity". Data of "film length for reference package length" and "packaging capacity" is inputted to the controller as will be explained later. In an empty-package prevention control which will be explained later, a speed-reducing and stopping control as well as a starting and speed-increasing control is performed for the film feeding mechanism including the film drawing rollers 8, the film feeding rollers 11 and the seal rollers 11. An encoder E2 is associated with the servo motor M2 for outputting pulse signals in response to a film feeding position and the feeding speed of the film feeding mechanism.

The end sealer 6 is driven by a servo motor M3 for sealing and cutting the tubular film 3A in a position between two adjacent articles W1 so as to successively form the packages W2. Since the speed of the end sealer 6 is controlled to be varied as will be explained later, an encoder E3 is associated with the servo motor M3 for outputting pulse signals in response to a rotational position and a rotational speed of the end sealer 6.

In the normal operation, based on the data relating to "film length for reference package length" and "packaging capacity" as well as data relating to "distance (SL) between two adjacent articles W1" inputted to the controller, the end sealer 6 is operated to seal and cut the tubular film 3A in the crosswise direction in a central position between two adjacent articles W1 having the reference length.

An article detection sensor F1 shown in FIG. 1 successively detects the articles W1 during transportation by the supply conveyor 5. The article detection sensor F1 continuously outputs a detection signal as long as the article W1 is detected. However, the control circuit of the controller receives only a part of the detection signal which is outputted when the sensor F1 detects the front end of the article W1, and such a part of the detection signal is used to determine the length of the article W1.

A supply origin sensor F2 outputs an origin signal when each pusher 7 is inclined downwardly or when each pusher 7 reaches the position for feeding the article W1 into the tubular film 3A. However, once the origin signals are outputted to and stored in a control circuit of the controller during a setting operation prior to the normal operation, no further origin signal is received by the control circuit. Here, the setting operation is performed to synchronize the servo motors M1 of the supply conveyor 5, the servo motor M2 of the film feeding mechanism and the servo motor M3 of the end sealer 6 with each other.

As will be explained later, current positions of the pushers 7 are recognized on the basis of the signals from the supply origin sensor F2 and the signals from the encoder E1. An end sealer origin sensor F3 outputs an origin signal when the end sealer 6 reaches an origin position displaced by an angle of 180° in the rotational direction from an engaging position for sealing engagement.

Figure 12A:
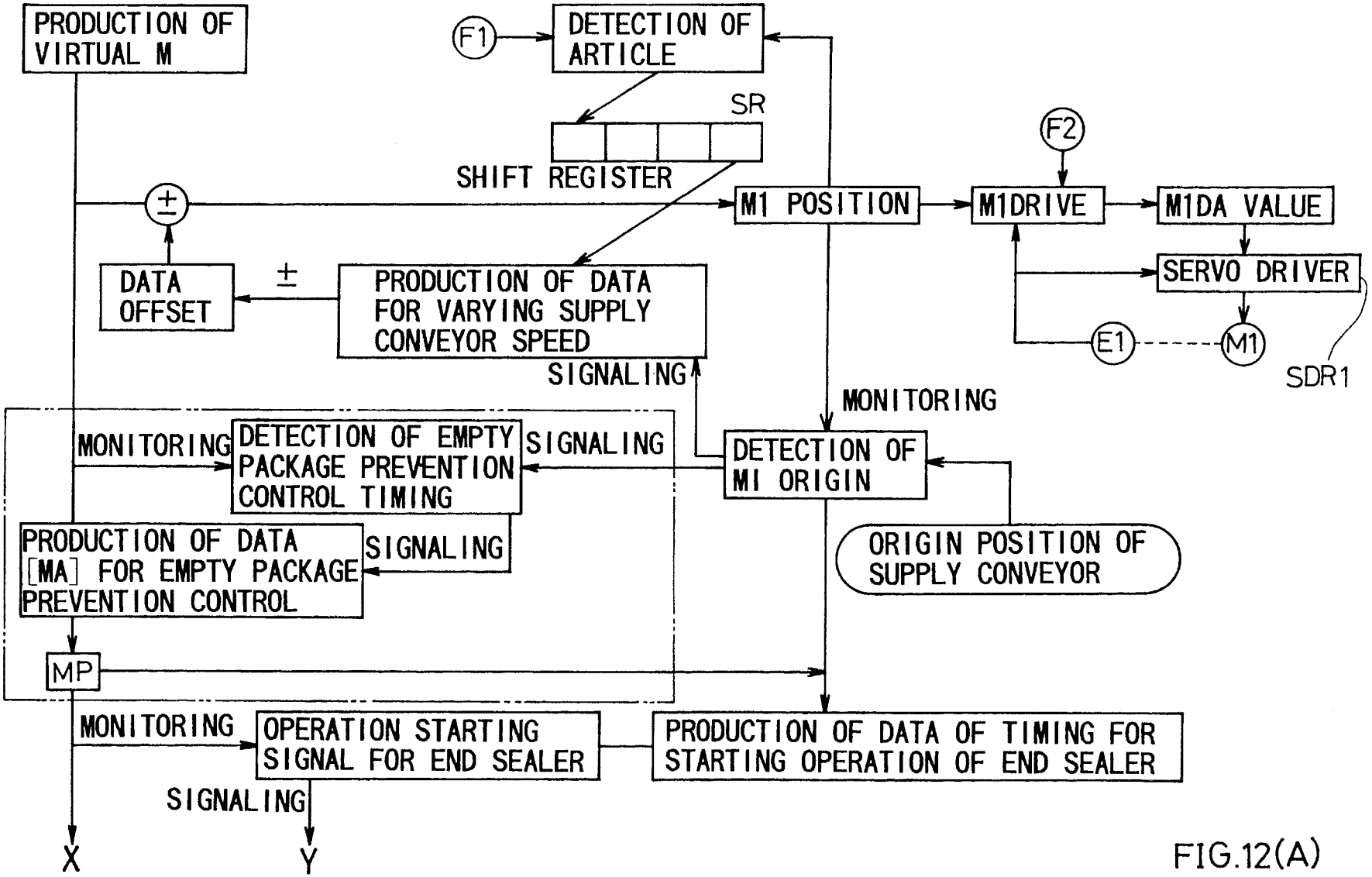
FIGS. 12(A) and 12(B) are block diagrams of a controller of the machine.
Figure 12B:
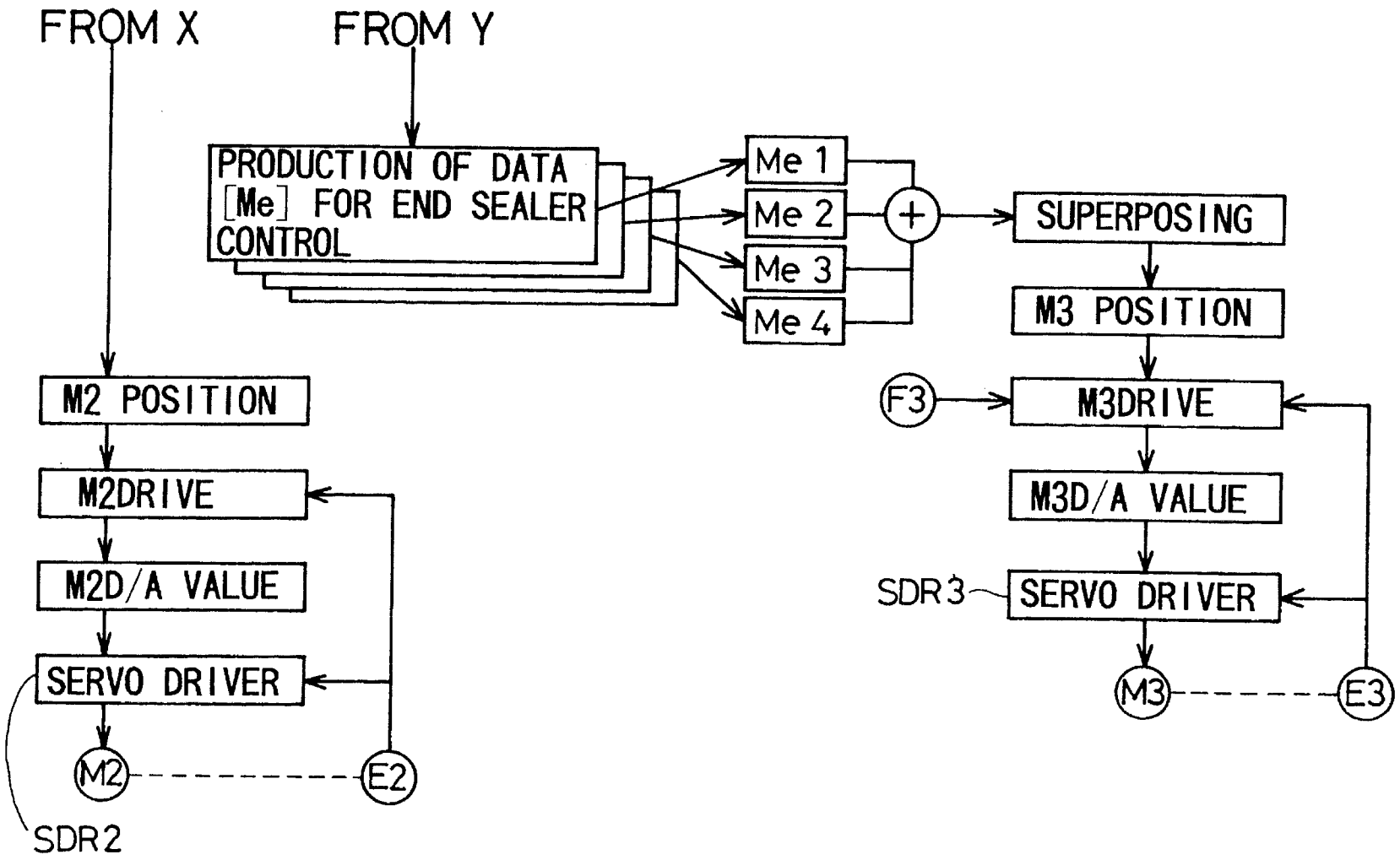

The article detection sensor F1, the supply origin detection sensor F2, the end sealer origin sensor F3 and the encoders E1, E2 and E3 are connected to an input side of the control circuit, while the servo motors M1 for the supply conveyor 5, the servo motor M2 for the film feeding mechanism and the servo motor M3 for the end sealer 6 are connected to servo drivers SDR1, SDR2 and SDR3 of the control circuit, respectively. The servo drivers SDR1, SDR2 and SDR3 are shown in FIGS. 12(A) and 12(B) and will be explained later.

A control operation of the servo motor M1 for driving the supply conveyor 5 will now be explained with reference to FIGS. 2, 3 and 4.

During the setting operation of the machine 1 for synchronization of the servo motors M1, M2 and M3 with each other, the current positions of the pushers 7 are recognized on the basis of the origin detection signals from the supply origin sensor F2 and the pulse signals from the encoder E1.

In connection with the drive control of the supply conveyor 5 by the servo motor M1, the pushers 7 are equally spaced from each other, and one pitch of the pushers 7 as well as the reference length of the article W1 is defined by the number of pulses of predetermined frequency. Thus, the reference length of the article W1 is determined by ["reference package length"–"distance (SL) between two adjacent articles W1"], The data of "reference package length" and "distance (SL) between two adjacent articles W1" is inputted to the controller. The value of the reference length thus obtained is converted into the number of pulses which correspond to the number of pulses for one pitch of the pushers 7, so that the reference length is defined. In addition, if the length of the article W1 detected by the article detection sensor F1 is different from the reference length, the difference between these length are also converted into the number of pulses.

Figure 2:
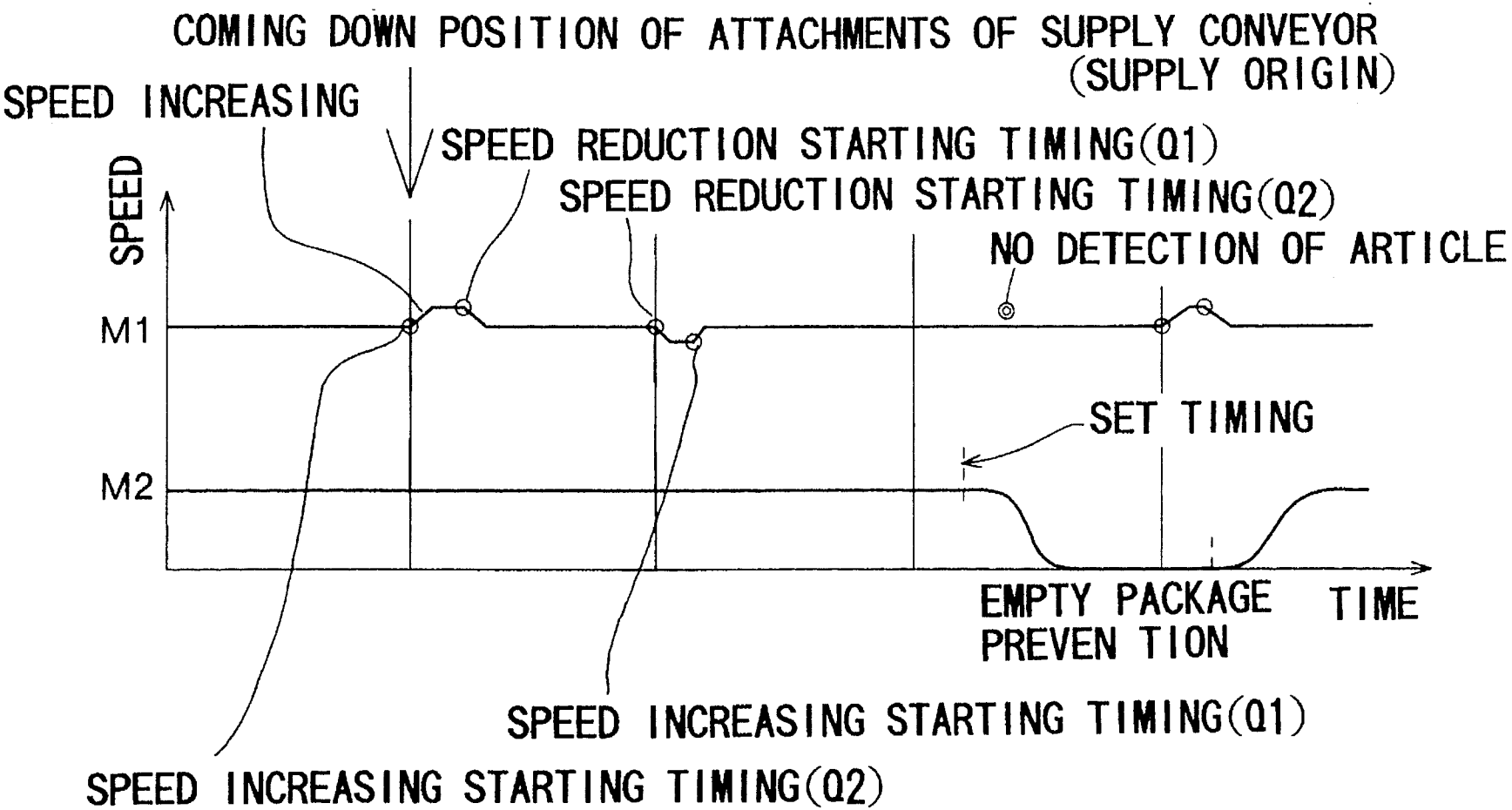
FIG. 2 is a timing chart showing variable speed control of servo motors for driving a supply conveyor and a film feeding mechanism of the machine shown in FIG. 1.

Referring to FIG. 2, there is shown a chart illustrating a speed increasing and reducing control of the servo motor M1 for the supply conveyor 5. As will be seen from FIG. 2, the speed of the servo motor M1 is increased when the length of the article W1 detected by the article detection sensor F1 is shorter than the reference length. On the other hand, the speed of the servo motor M1 is reduced when the length of the article W1 is greater than the reference length. The control to increase or reduce the speed of the servo motor M1 is started on the basis of the origin detection signals stored in the setting operation when each pusher 7 reaches the position to be downwardly inclined.

The speed increasing and reducing control to cope with the difference between the length of the article W1 and the reference length is performed basically in a pattern that the speed is increased (reduced) from a reference speed to a uniform speed and is thereafter reduced (increased) to the reference speed.

In order to perform such a variable speed control of the supply conveyor 5, data relating to number of pulses and acceleration for speed increase (decrease) is inputted to the controller by means of a key board, etc. Based on these data, a period (ACT) after increasing (reducing) the speed until reaching the uniform speed is calculated from the following expression (1), and the value of the uniform speed is then determined:

$$ACT=TOP/AC(\times tmsec) \quad (1)$$

Number of pulses for speed increase: TOP (number of pulses/tmsec)

Acceleration: AC [number of pulses/tmsec]/tmsec

Here, the period after increasing (reducing) the speed from the reference speed until reaching the uniform speed is equal to the period after reducing (increasing) the speed from the uniform speed until reaching the reference speed. Further, the amount of movement of the conveyor 5 during the latter period is the same as the amount of movement during the former period.

Figure 3:
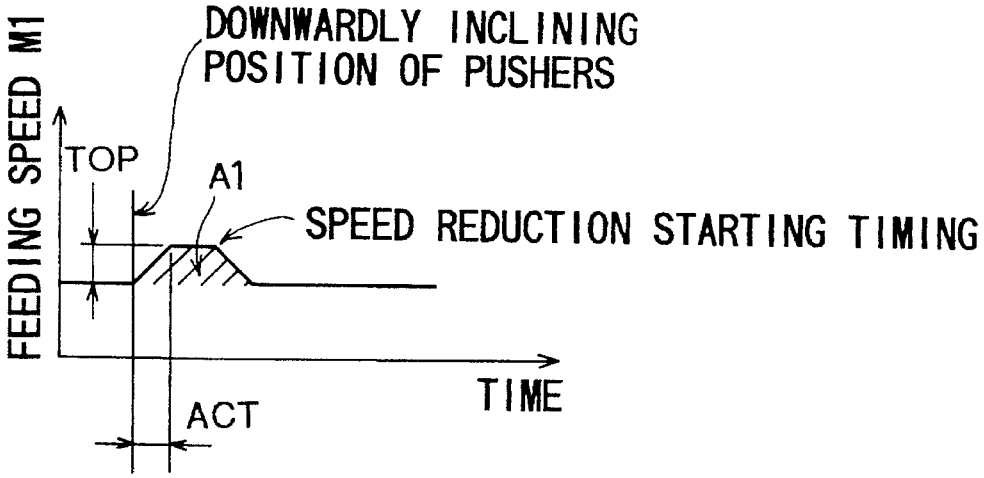
FIG. 3 is an explanatory graph showing a speed increasing and decreasing control of the servo motor of the supply conveyor.

Therefore, when a difference A1 between the length of the article W1 and the reference length is greater than TOP (number of pulses for speed increase)×ACT (period after increasing (reducing) the speed until reaching the uniform speed), the speed reducing (increasing) timing is set during the uniform speed period as shown in FIG. 3. Thus, the speed reducing (increasing) timing is determined by the following expression (2) for the variable speed control pattern:

$$A1/TOP\ [\times tmsec] \quad (2)$$

Figure 4:
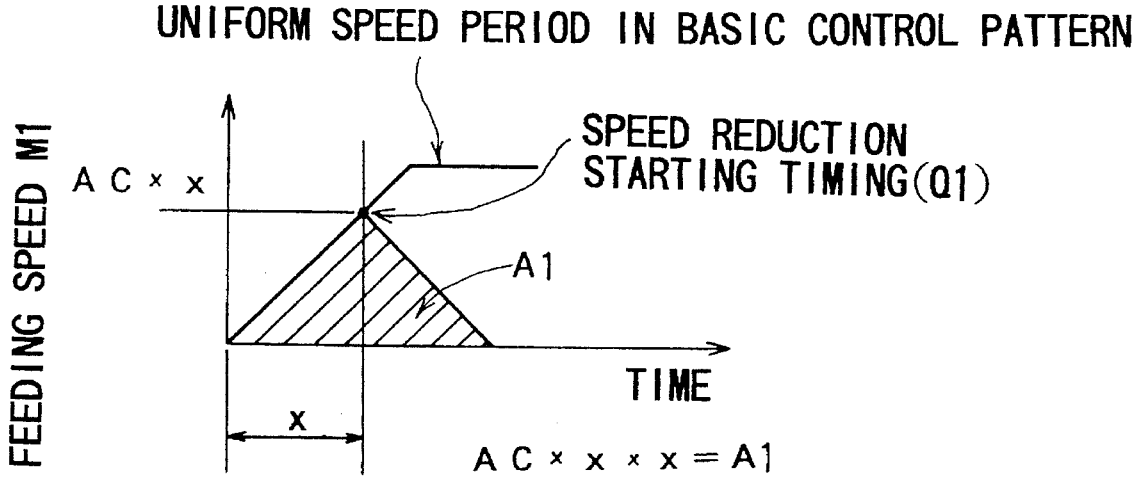
FIG. 4 is a graph similar to FIG. 3 but showing a different control pattern.

When the difference A1 is smaller than TOP×ACT, the speed reducing (increasing) timing is set during the speed increasing (reducing) period as shown in FIG. 4. Thus, the speed reducing (increasing) timing is determined by the following expression (3) for the variable speed control pattern:

$$(A1/AC)^{1/2}[\times tmsec] \quad (3)$$

Meanwhile, in the normal operation, the servo motor M2 for the film feeding mechanism feeds the film 3A at a reference feeding speed determined by ["reference film length for reference package length"×"packaging capacity"]. The data of "reference film length for reference package length" and "packaging capacity is inputted to the controller. However, when no article W1 has been detected for any of the pushers 7, the feeding speed is temporarily reduced to become zero. The feeding mechanism is again started when the article W1 has been detected for the subsequent pusher 7. No empty package is therefore produced.

Figure 5:
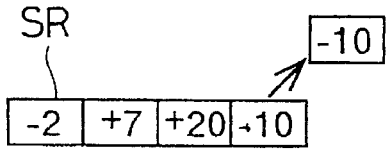
FIG. 5 is an explanatory view of a register in which pulse data for speed increasing and decreasing control of the servo motor of the supply conveyor is stored.

As described above, when the article detection sensor F1 detects the article W1, the length of the article W1 is calculated on the basis of the signal inputted to the control circuit, and at the same time therewith, the number of pulses for increasing or reducing the speed of the supply conveyor 5 is calculated on the basis of the difference between the length of the article W1 and the reference length. Data of the number of pulses is then successively stored in a shift register SR having four frames (see FIGS. 5 to 7). The supply origin signals are successively produced as the pushers 7 reach the positions to be downwardly inclined, and based on the supply origin signals, among the data of the number of pulses stored in the shift register SR, the data part (-10 in FIG. 5) stored in the rightmost frame in FIG. 5 is in turn picked up. Based on the picked data part, the controller calculates a timing Q1 for reducing (increasing) the speed of the conveyor 5 and performs the necessary speed reducing (increasing) control. A timing Q2 for increasing (decreasing) the speed from the normal speed is fixed to coincide with the timing when each pusher 7 reaches the supply origin.

Figure 6:
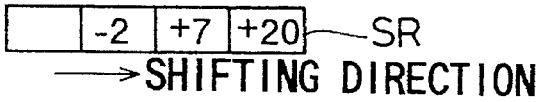
FIG. 6 is a view similar to FIG. 5 but showing the state where each stored data part has been shifted.
Figure 7:
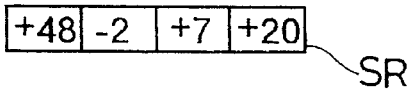
FIG. 7 is a view similar to FIG. 5 but showing the state where new data has been stored.

When the rightmost data part (-10) is picked up from the shift register SR, the remaining data parts are in turn shifted rightwardly by one frame as shown in FIG. 6, so that the leftmost frame of the shift register SR becomes empty. However, when the next article W1 is detected by the article detection sensor F1, the controller calculates the number of pulses for increasing or decreasing the speed based on the difference between the length of that article W1 and the reference length, and such calculated number of pulses is then stored in the leftmost frame of the shift register SR as shown in FIG. 7.

A description will now be given as to the control of the end sealer 6 for crosswise sealing of the tubular film 3A in a position between each two adjacent articles W1.

The control of the end sealer 6 has a basic pattern in which one cycle of control is performed such that, upon receiving an operation starting signal, the end sealer 6 is rotated at one time starting from a waiting position where the tubular film 3A does not receive any thermal influence from sealing surfaces of the end sealer 6. The waiting position may be a 180° position displaced 180° from an engaging position of the sealing surfaces or may be selectively determined within a range between +90° and −90° from the 180° position. In this embodiment, the waiting position is set to the 180° position. During one rotation of the end sealer 6, the following control is performed for the servo motor M3 for driving the end sealer 6. Upon inputting the operation starting signal to an end sealer control circuit of the control circuit indicated as M3DRIVE in FIG. 12(B), the servo motor M3 is started to be driven. The speed of the servo motor M3 is controlled such that the rotational speed of the sealing surfaces of the end sealer 6 substantially coincide with the moving speed of the tubular film 3A when the end sealer 6 reaches the engaging position for sealing the tubular film 3A. Further, based on the packaging capacity set in the controller, the rotational speed of the end sealer 6 is continuously variably controlled through the servo motor M3 such that the end sealer 6 is rotated at one time during a predetermined time so as to provide a reference package length corresponding to the reference length of the article W1. When the length of the article W1 is different from the reference length, the speed is varied to cope with such difference in length.

Although the variable rotational speed control is performed for the servo motor M3 as described above, for ease of explanation, the following description will be given on the assumption that an uniform rotational speed control is performed.

Figure 8:
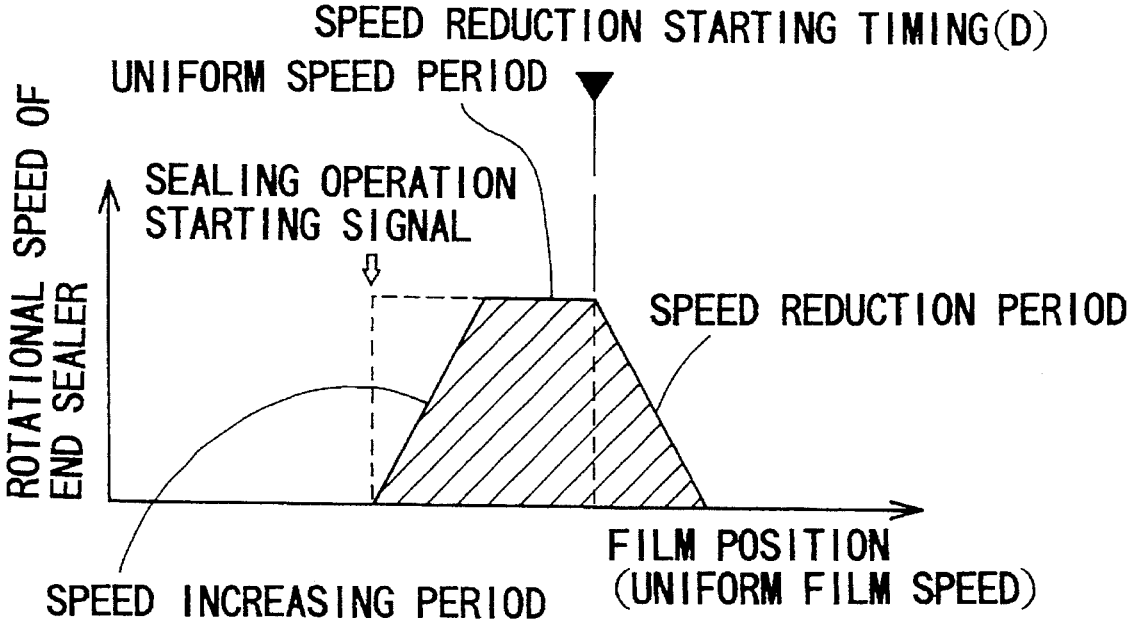
FIG. 8 is an explanatory graph showing a basic speed increasing and decreasing control of an end sealer of the machine.
Figure 9:
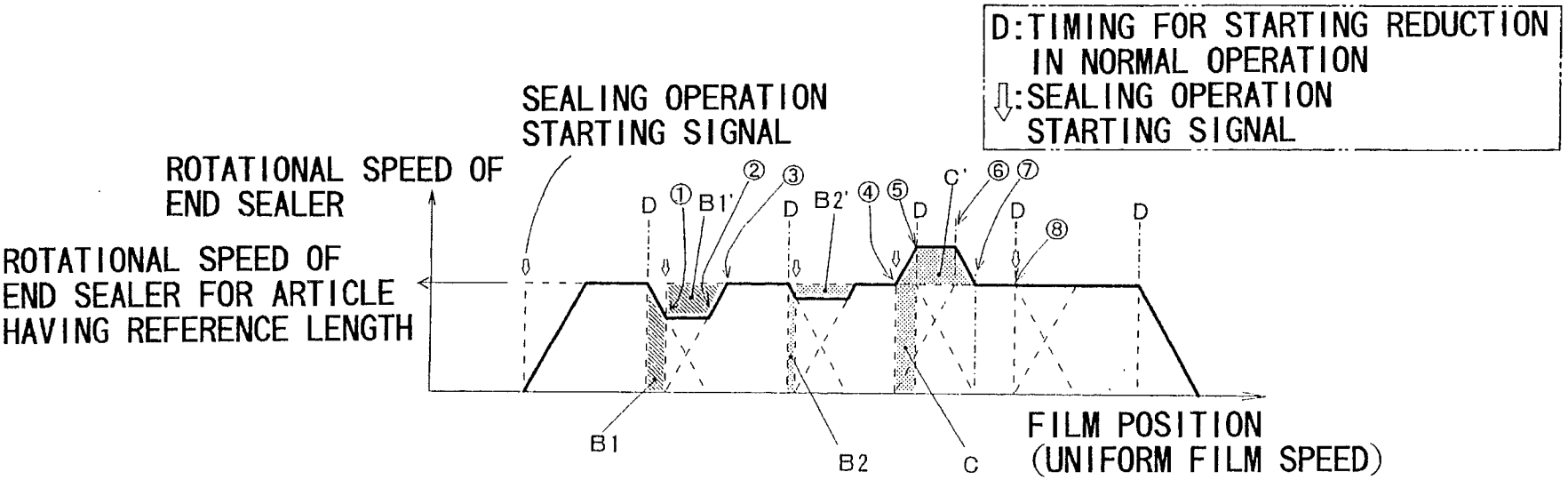
FIG. 9 is an explanatory graph showing various control patterns of continuous speed increasing and decreasing control when the articles having different length from a reference length are to be packaged.

FIGS. 8 and 9 are explanatory graphs showing the rotational speed of the end sealer 6 (in the axis of ordinates) with respect to the position of the film 3A when the length of the article W1 is different from the reference length. Here, the end sealer 6 is continuously rotated on the condition that the servo motor M3 is driven at the uniform speed as described above. As shown in FIG. 8, the rotational control of the end sealer 6 is performed basically in a pattern including a speed increasing period, a speed reducing period and a uniform speed period. The speed increasing period is started when the operation starting signal is outputted. The speed reducing period is started from a speed reduction starting timing D and continues until the speed is reduced to zero. Data for increasing and reducing the speed in the speed increasing and reducing periods is inputted to the controller. The uniform speed period is determined such that, during the total periods of the speed increasing period, the speed reducing period and the uniform speed period, the end sealer 6 is rotated at one time which corresponds to a film feeding length for one package of the article W1 having the reference length.

When the articles W1 having different length from each other are fed into the tubular film 3A one after another, the basic pattern is modified to include a speed varying control during the rotation of the end sealer 6. Thus, when the length of the article W1 supplied into the tubular film 3A is greater than the reference length, the operation starting signal is outputted at a timing later than the speed reduction starting timing D. Then, the end sealer 6 is rotated at a uniform speed from the timing of outputting of the operation starting signal (timing ① in FIG. 9) to a timing ② in FIG. 9 where the line of the uniform speed intersects the line of the speed increasing period of the basic pattern which starts from the timing ①. The speed is thereafter increased from the timing ② to reach the uniform speed period of the basic pattern at a timing ③ in FIG. 9.

When the length of the article W1 is shorter than the reference length, the operation starting signal is outputted at a timing ④ in FIG. 9 during the uniform speed period of the previous cycle of pattern, and the speed is increased from the timing ④ to a timing ⑤ corresponding to the speed reducing timing D by the same increasing ratio as the speed increasing period of the basic pattern. Then, the end sealer 6 is rotated at a uniform speed until a timing ⑥ corresponding to the end of the speed increasing period of the basic pattern. The speed is thereafter reduced to reach a normal uniform speed of the basic pattern for the reference length at a timing ⑦.

When the length of the article W1 coincides with the reference length, the speed reduction timing D of the basic pattern coincides with a timing ⑧ of outputting of the operation starting signal, so that the end sealer 6 is rotated at the normal uniform speed of the basic pattern.

With the above speed varying control of the end sealer 6, when the length of the article W1 fed into the tubular film W1 is greater than the reference length, the amount of rotation of the end sealer 6 is reduced by an amount corresponding to an area B1' or an area B2' in FIG. 9 which coincides with an amount of an area B1 or an area B2 in FIG. 9 corresponding to the amount of feeding of the tubular film 3A during the period from the speed reduction starting timing D to the timing of outputting the operation starting signal On the other hand, when the length of the article W1 is shorter than the reference length, the amount of rotation of the end sealer 6 is increased by an amount corresponding to an area C' in FIG. 9 which coincides with an area C in FIG. 9 corresponding to the amount of feeding of the tubular film 3A during the period from the timing of outputting the operation starting signal to the speed reduction starting timing D.

The servo motor M3 is thus controlled to vary its rotational speed such that the rotational position of the end sealer 6 with respect to the film 3 fed at the uniform speed is adjusted in response to the difference between the length of the article W1 fed into the tubular film 3A and the reference length. Consequently, the end sealer 6 can provide an excellent corsswise seal in a central position between two adjacent articles W1.

The timing of outputting of the sealing operation starting signal is determined on the basis of the position of the tubular film 3A where the article W1 is fed into the tubular film 3A from the supply conveyor 5. More specifically, the timing of outputting the sealing operation starting signal is determined by the number of pulses which represent the position of the tubular film 3A such that the crosswise seal is performed in a central position between the rear end of the article W1 and the front end of the next article W1 through engagement of the sealing surfaces of the end sealer 6.

When the supply origin signal is outputted due to the supply of the article W1 into the tubular film 3A (due to downward inclining movement of the pusher 7), pulse data which are obtained from the pulses outputted from the encoder E2 associated with the servo motor M3 are read out. Based on the read-out data, a calculation process which will be explained later is performed, so that the timing of outputting the operation starting signal corresponding to the position for crosswise sealing rearwardly of the article W1 fed to the tubular film 3 is stored in a register (not shown) as pulse data representing the moving position of the film 3.

Figure 10:
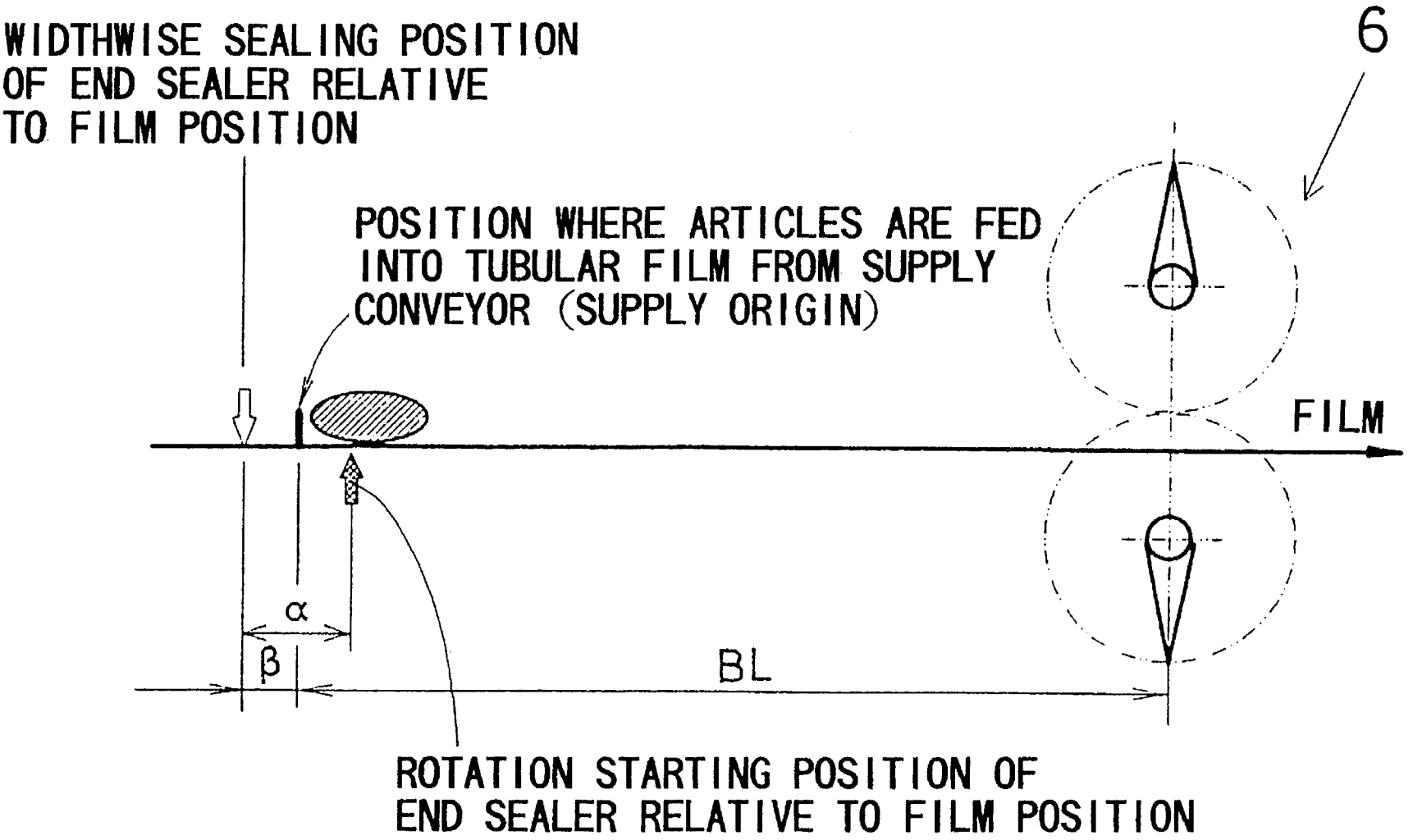
FIG. 10 is a schematic view showing the operation of the end sealer.

The calculation process will now be explained with reference to FIG. 10 in connection with the timing of outputting the operation starting signal which is produced when the article W1 is fed into the tubular film 3A for representing the crosswise sealing position.

The following expression is used to calculate the number of pulses FP representing the distance of the film 3A between the center of rotation of the end sealer 6 and the position where the article W1 is fed into the tubular film 3A (the position where the corresponding pusher 7 is brought to be inclined downwardly):

$$FP=(BL+NL)\times P$$

BL: distance between the center of rotation of the end sealer 6 and the position where the article W1 is fed into the tubular film 3A

P: number of pulses corresponding to the film length for one reference package length NL: film length for one reference package length The position of the tubular film 3A to be sealed by the end sealer 6 is rearwardly of the position which is obtained by the above expression and which corresponds to the position of the rear end of the article W1 at the time when the article W1 is fed into the tubular film 3A. The former position and the latter position is spaced from each other by the distance of ½ times the distance SL between two adjacent articles W1 fed into the tubular film 3A. In addition, since the waiting position of the end sealer 6 is displaced by an angle of 180° from the engaging position, the timing of sealing operation of the end sealer 6 is obtained, as the number of pulses corresponding to the amount of feeding of the film 3A from the current position, while taking into account of the film feeding length during the rotation from the waiting position to the engaging position of the end sealer 6. Data of such number of pulses is successively stored in a memory of the controller. Thus, the data of number of pulses representing the film position is calculated from the following expression:

$$\text{Sealing operation starting timing}=FP+fp+\beta-\alpha$$

fp: number of pulses at the current film position counted from the position where the article W1 is fed into the tubular film 3A

α: number of pulses (P/2) corresponding to the film feeding amount during rotation of the end sealer 6 from the waiting position to the engaging position β: number of pulses corresponding to the distance of ½ times the distance (SL) between two adjacent articles W1 fed into the tubular film 3A

The operation starting signal is outputted when the number of pulses concerning the film position, which has been continuously stored in the memory during movement of the film 3, reaches a stored pulse data, so that the end sealer 6 is controlled to perform the crosswise seal in the central position between two adjacent articles W1. During one rotation of the end sealer 6, the speed varying control is performed in response to the difference between the length of the article W1 fed into the tubular film 3A and the reference length. In addition, as long as the articles W1 are successively fed into the tubular film 3A, the data concerning the timing of the operation starting signal of the end sealer 6 is successively stored in the memory. Based on the stored data, the control circuit calculates the continuous speed varying control pattern, and the rotational speed of the end sealer 6 is controlled according to the calculated pattern data.

Figure 11:
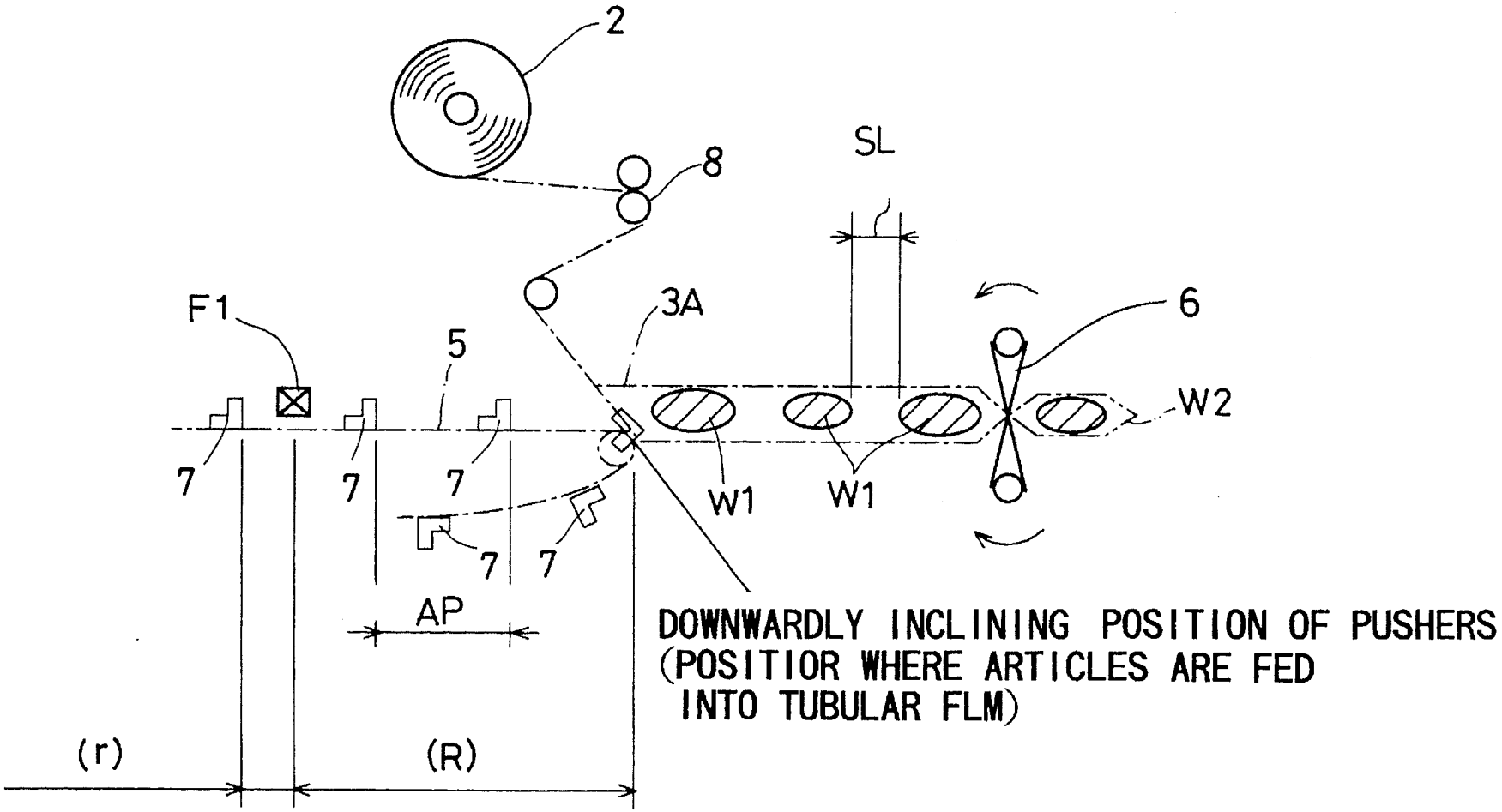
FIG. 11 is a view similar to FIG. 1 but showing various basic parameters for controlling the supply conveyor and the end sealer.

The following data is inputted to the control circuit for the control of the supply conveyor 5, the control for the uniform speed of the film 3 and the control of the end sealer 6 as described above (FIG. 11 is an explanatory view showing these data):

(1) Film length for one reference package length (2) Packaging capacity (number of packages of the articles having the reference length to be produced during a predetermined time)

(3) Distance (SL) between two adjacent articles W1 fed into the tubular film 3A

(4) Pitch (AP) of the pushers 7 on the supply conveyor 5

(5) Distance (r) between the article detection sensor F1 and one of the pushers 7 positioned rearwardly of the sensor F1 when any one of the pushers 7 has brought to be inclined (distance (r) is used for calculating the length of the article)

(6) Distance (R) between the sensor F1 and the position where the pushers 7 are brought to be inclined Here, the distance (R) is used to determine the number of the pushers 7 which will be brought to be inclined after any one of the articles W1 has been detected by the sensor F1, and based on such number, after the article W1 has been detected by the sensor F1, the variable speed control of the supply conveyor 5 is performed in response to the length of the detected article W1.

(7) Values (TOP and AC) for increasing and reducing the speed of the supply conveyor 5 during the variable control of the same (8) Values for increasing and reducing the speed of the end sealer 6 during the variable control of the same Referring to FIGS. 12(A) and 12(B), there is shown a block diagram of the control circuit of the servo motors M1, M2 and M3. The servo motor M1 drives the supply conveyor 5. the servo motor M2 drives the film feeding mechanism including the film drawing rollers 8, the film feeding rollers 10 and the seal rollers 11. FIGS. 13 to 17 show flowcharts illustrating the control process of the supply conveyor 5, the film drawing rollers 8 and the end sealer 6 through driving control of the servo motors M1, M2 and M3.

The control of the supply conveyor 5, the film drawing rollers 8 and the end sealer 6 is performed by the control circuit including a microcomputer (not shown) as a main part and will now be described with reference to FIGS. 12(A) and 12(B) to FIG. 17. In FIG. 12(A), virtual M is a circuit to produce a basic clock pulse for the control circuit.

A supply conveyor control circuit M1DRIVE outputs a drive signal (converted into an analog valued at M1DA) to the servo driver SDR1 for driving the servo motor M1. A film feeding control circuit M2DRIVE outputs a drive signal (converted into an analog value at M2DA) to the servo driver SDR2 for driving the servo motor M2. An end sealer control circuit. M3DRIVE outputs a drive signal (converted into an analog value at M3DA) to the servo driver SDR3. The servo drivers SDR1, SDR2 and SDR3 supply drive currents to the servo motors M1, M2 and M3, respectively. The encoders E1, E2 and E3 are associated with the servo motors M1, M2 and M3, respectively, as described above.

Figure 13:
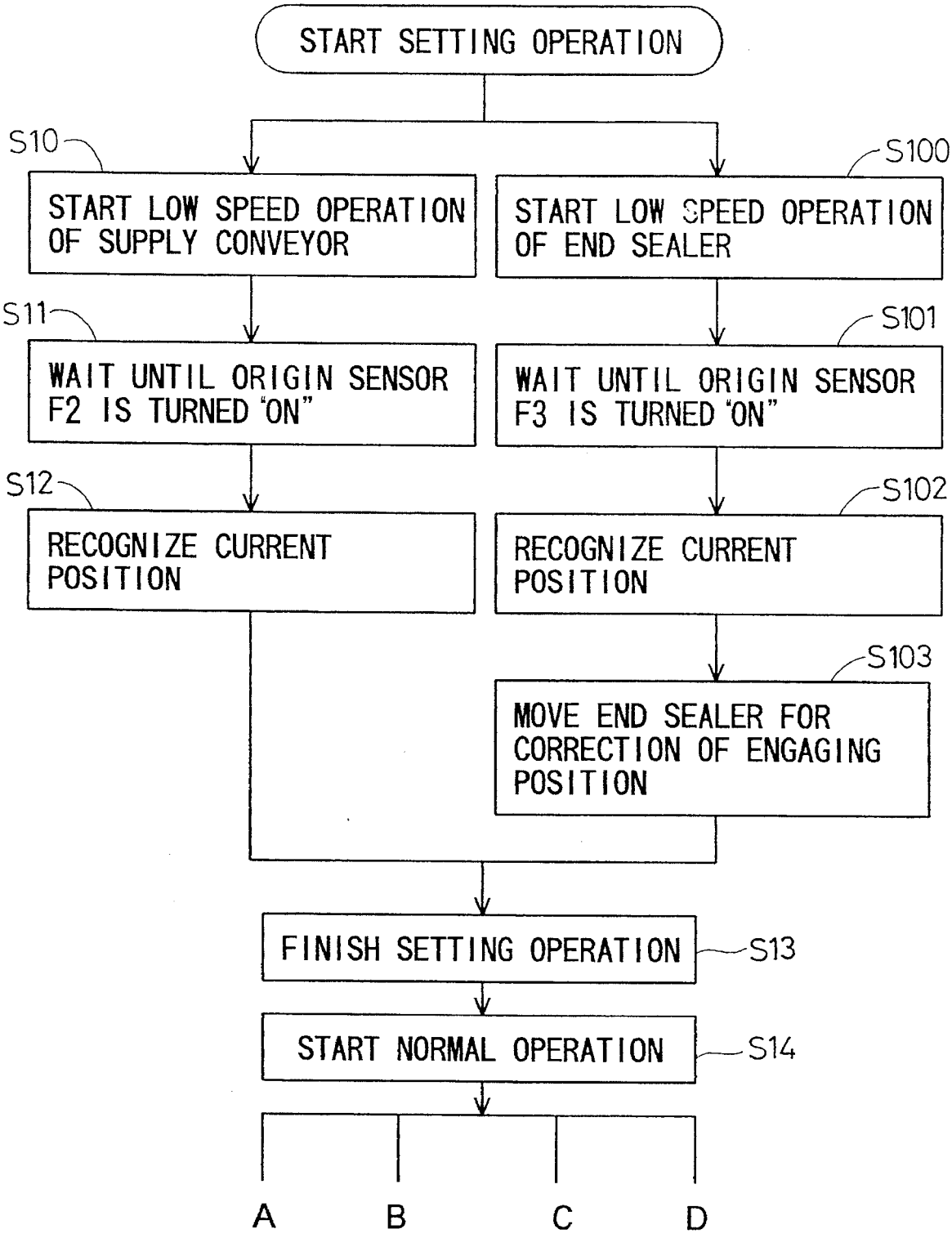
FIG. 13 is a flow chart showing a control for a setting operation of the machine.

The flowchart shown in FIG. 13 illustrates the control for the setting operation which is started when a start button (not shown) of the controller is operated after a power is supplied to the machine 1.

In Steps S10, S11 and S12, the supply conveyor 5 is started for movement at low speed. Then, the supply origin sensor F2 outputs origin detection signals which are stored in the register as supply origin signals for synchronizing the position of the supply conveyor 5 with the position of the end sealer 6. In addition, based on the supply origin signals and output pulse signals from the encoder E1, the current positions of the pushers 7 on the supply conveyor 5 are recognized.

On the other hand, in Steps S100, S101, S102 and S103, the end sealer 6 is started for rotation at lower speed. Then, the end sealer origin sensor F3 outputs an origin detection signal which is stored in the register as a sealer origin signal for synchronizing the position of the end sealer 6 with the position of the supply conveyor 5. In addition, based on the sealer origin signal and output pulse signals from the encoder E3, the current rotational position of the end sealer 6 is recognized.

Further, the position of the end sealer 6 relative to the position of the supply conveyor 5 is adjusted such that the crosswise seal is performed in a position between two adjacent articles W1 having the reference length which is given from the inputted data. In other words, the engaging position of the end sealer 6 is adjusted.

When the setting operation of the supply conveyor 5 and the end sealer 6 has been completed in Step S13, the machine 1 is stopped, and then the operation mode of the machine is changed to a continuous operation mode.

When the start button is operated in Step S14, the supply conveyor control circuit M1DRIVE, the film feeding control circuit M2DRIVE and the end sealer control circuit M3DRIVE output driving signals to the servo driver SDR1, the servo driver SDR2 and the servo driver SDR3, respectively, so that the servo motors M1, M2 and M3 are simultaneously started to drive the supply conveyor 5, the film feeding mechanism and the end sealer 6, respectively, and so that the servo motors M1, M2 and M3 are driven synchronously with each other with respect to their speed and positions in response to the inputted data of the packaging capacity and the reference length of the articles W1.

Figure 14:
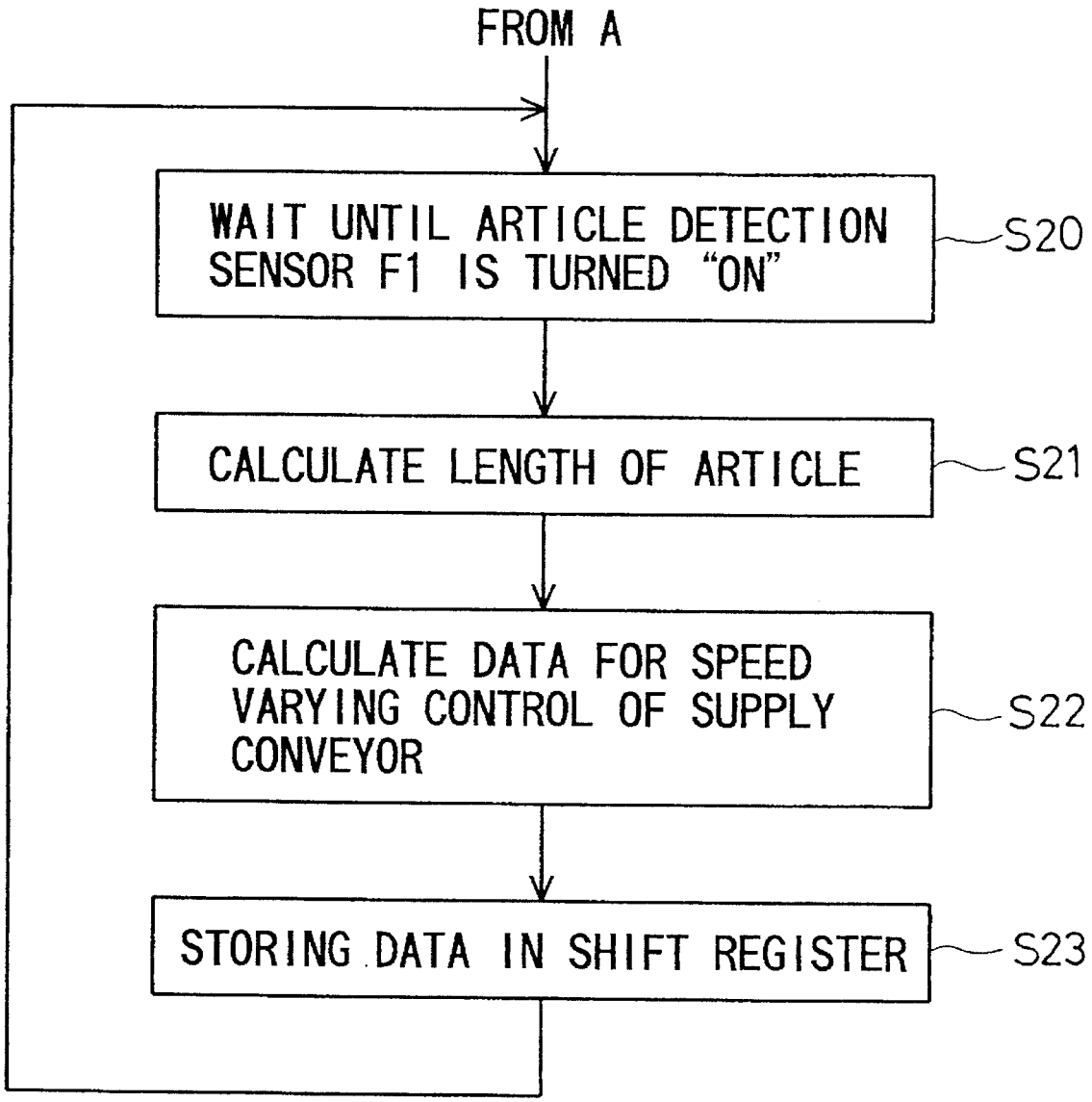
FIGS. 14 to 17 are various flow charts showing various controls each subsequently performed after the control of the flow chart shown in FIG. 13.
Figure 15:
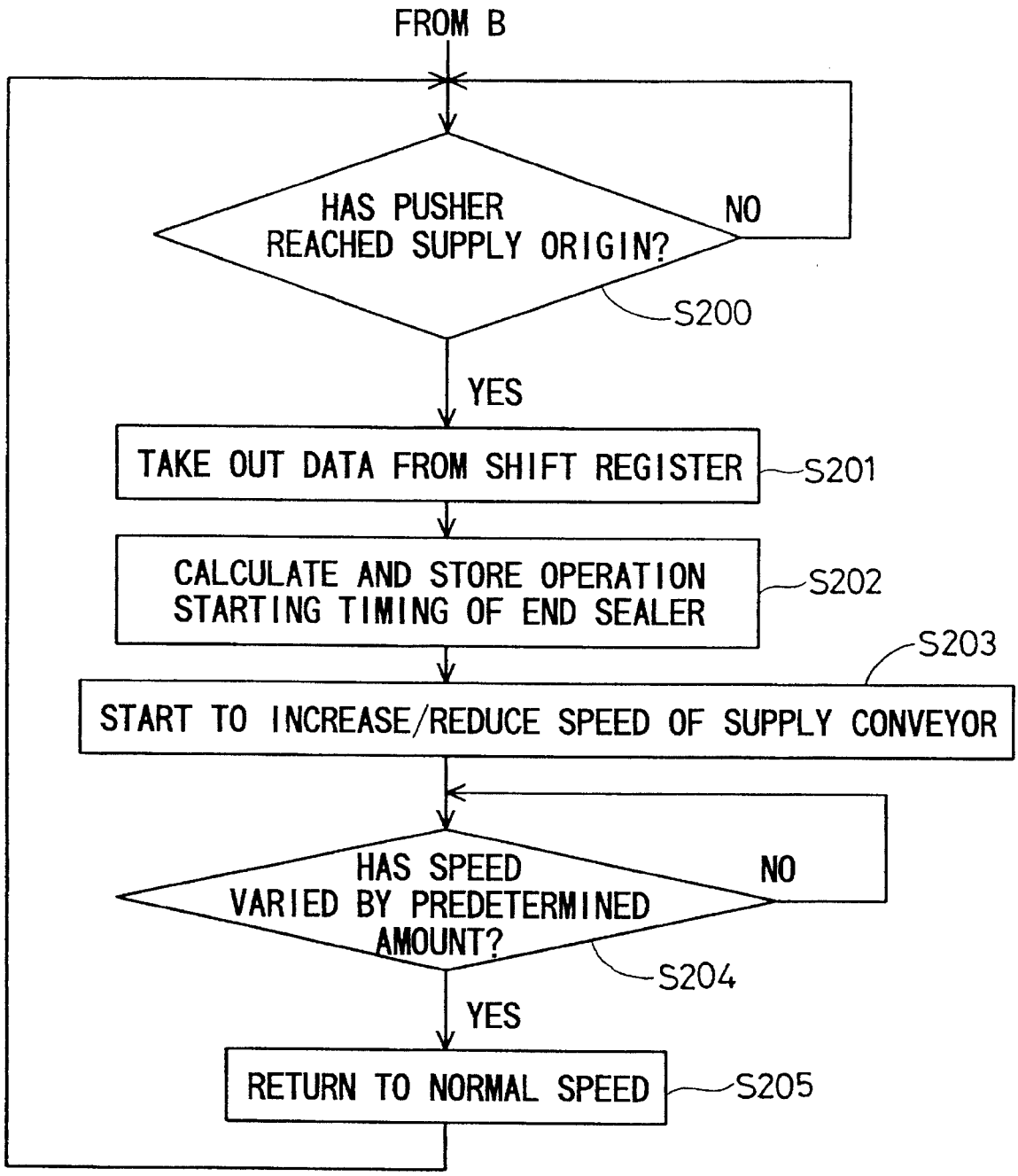
Figure 16:
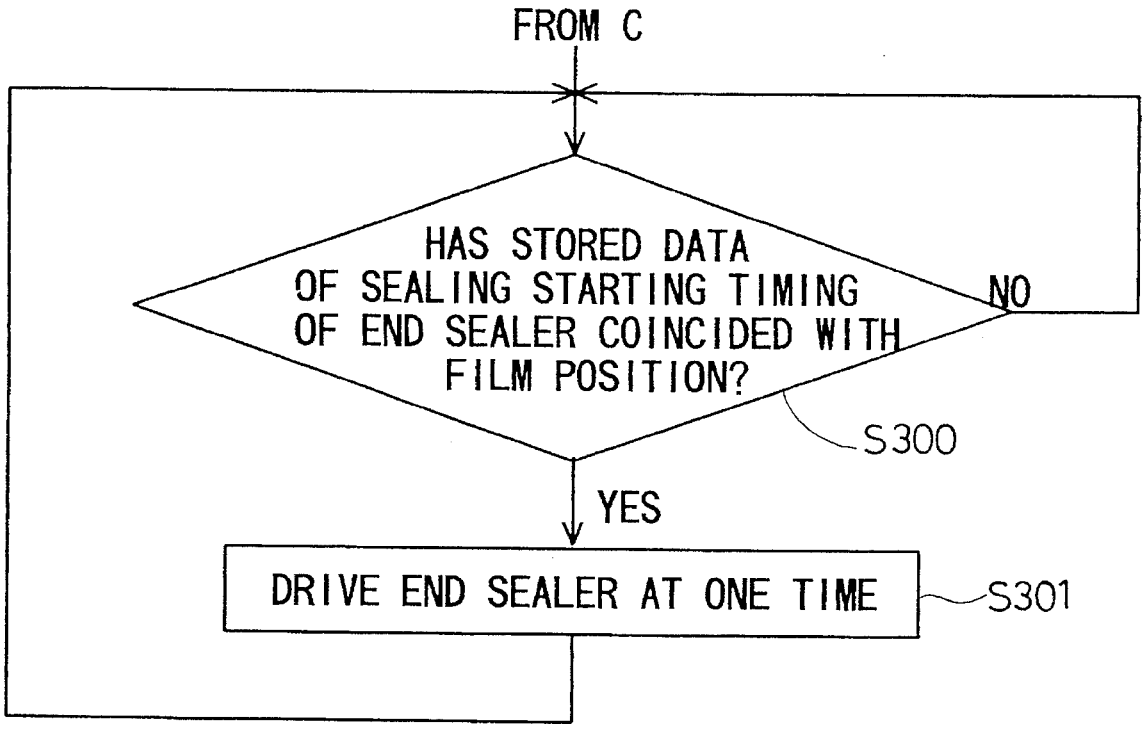
Figure 17:
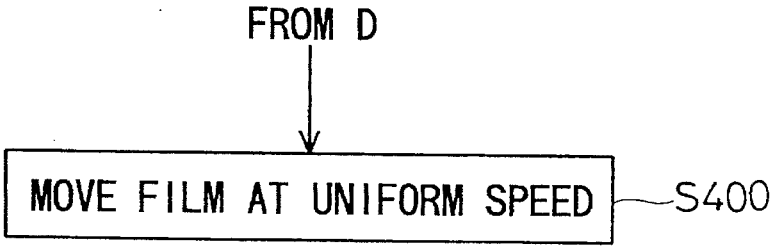

Alphabets A, B, C and D in FIG. 13 following Step S14 indicate that the process proceeds from Step S14 to Step S20 in FIG. 14, to Step S200 in FIG. 15, to Step S300 in FIG. 16 and to Step S400 in FIG. 17, respectively.

In Step S20 of FIG. 14, the article detection sensor F1 outputs the article detection signals when it detects the articles W1 each supplied between two adjacent pushers 7 of the supply conveyor 5 one after another. The process then proceeds to Step S21 where the difference between the length of each article W1 and the reference length is calculated from the current position of the conveyor 5 at the time when the detection signal is outputted, based on the inputted data of the distance (r) between the article detection sensor F1 and the pusher 7 positioned just rearwardly of the sensor F1 when any of the pushers 7 has brought to be downwardly inclined.

The process then proceeds to Step S22 where the pulse data of the amount of increasing or decreasing the speed of the supply conveyor 5 is calculated on the basis of the inputted data of the distance SL between two adjacent articles W1 such that the articles W1 are equally spaced from each other when the articles W1 are fed into the tubular film 3A. The calculated pulse data is then stored in the shift register SR in Step S23, and the process returns to Step S20.

Step S200 of FIG. 15 determines whether any of the pushers 7 is at the supply origin position (downwardly inclining position). If the determination is YES, the process proceeds to Step S201 where the part of the data positioned in the rightmost frame of the shift register SR is taken out. The process then proceeds to Step 202 where the operation starting timing of the end sealer 6 is calculated to correspond to the pulse data of the film position and where the calculated data is stored in the register. The control for increasing or decreasing the speed of the supply conveyor 5 is then started in Step S203 based on the pulse data taken out from the rightmost frame of the shift register SR. Step S204 determines whether the speed has been varied by the necessary amount. If the determination is YES, the process proceeds to Step S205 where tile speed of the supply conveyor 5 returns to normal, and the process thereafter returns to Step S200.

Step S300 of FIG. 16 determines whether the pulse value of the current film position coincides with the pulse data of the film position for the sealing operation starting signal stored in the register. If the determination is YES, the process proceeds to Step S301 where the sealing operation starting signal is outputted to the end sealer control circuit M3DRIVE shown in FIG. 12(B) so as to drive the servo motor M3 and to rotate the end sealer 6 at one time. During such rotation of the end sealer 6, the speed varying control is performed in addition to the basic variable speed control if the length of the article W1 is different from the reference length.

Meanwhile, as described in connection with FIGS. 8 and 9, as for the rotational control of the end sealer 6, the operational data during the continuous rotation of the end sealer 6 is determined on the basis of the data of the sealing operation starting signals which are successively stored in the memory. More specifically, the operational data is obtained through superposition of operation control data Me1, Me2, Me3 and Me4 shown in FIG. 12(B). Based on the operational data thus obtained, the speed varying control is performed in response to the difference between the length of the article W1 and the reference length.

On the other hand, in Step S400 of FIG. 17, the film feeding control circuit M2DRIVE shown in FIG. 12(B) outputs a control signal to drive the servo motor M2 at a uniform speed corresponding to the film feeding speed obtained from "reference package length"×"packaging capacity" both inputted to the controller. The film drawing rollers 8, the film feeding rollers 10 and the film sealing rollers 11 are thus rotated synchronously with each other, so that the film 3 is fed at a uniform speed.

An empty package prevention process indicated by two-dotted chain lines in FIG. 12(A) is performed only when an empty package prevention control mode has been selected. No such a process is performed when the machine is in the normal operation mode.

A process for "detection of empty package prevention control timing" and a process for "production of empty package prevention control data (MP)" in the empty package prevention process will now be explained. When the article detection sensor F1 detects no article between two adjacent pushers 7, the servo motor M1 for the supply conveyor 5 is driven at the normal speed, while the servo motor M2 for the film feeding mechanism and the servo motor M3 for the end sealer 6 are temporarily stopped. The servo motors M2 and M3 are again started when the sensor F1 detects the article W1 between the subsequent two adjacent pushers 7.

Further, the crosswise sealing of the film in a position forwardly of the article W1 fed into the film at the first time is suitably performed by driving the end sealer 6 based on the reference length W1 of the article which is obtained from the inputted data.

As described above, with the horizontal form-fill-seal packaging machine 1 of this embodiment, the speed of the supply conveyor 5 is controlled to be varied in response to the difference between the length of the article W1 and the reference length determined by the inputted data, so that the articles W1 having difference length from each other and fed at random into the tubular film 3A moved at the uniform speed are equally spaced from each other on the tubular film 3A. The speed of the end sealer 6 is also controlled to be varied, so that end sealer 6 is brought into engagement for the crosswise seal of the tubular film 3A in the central position of the space between two adjacent articles W1.

Although in the above embodiment, the end sealer 6 is rotatably driven, the end sealer 6 may be driven to perform a box motion in which the sealing surfaces are moved up and down along arcuate paths in opposed relationship with each other so as to be moved toward and away from the positions for engagement with each other and in which the sealing surfaces in engagement with each other are moved horizontally by a predetermined distance for the crosswise seal of the film 3A.

Additionally, the data to be inputted to the controller as described above may be replaced by different kinds of data as follows:

(1) The data of "film length for reference package length" may be replaced by data of "reference package length". (The film length is to be obtained through calculation).

(2) The data of "film length for reference package length" and "packaging capacity (the number of packages having reference package length to be produced during the predetermined time) may be replaced by data of " film feeding speed".

(3) The data of "distance (SL) between two adjacent articles W1 to be fed into tubular film 3A" may be replaced by data of "reference length of article W1". (The distance (SL) may be calculated from "reference package length" or "film length for reference package length".)

(4) In place of inputting the data of "pitch of pushers 7 of supply conveyor 5", the article detection sensor F1 may detect the articles W1 during the setting operation so as to provide a pitch representing signal which is inputted to the controller, so that the pitch is automatically set.

While the invention has been described with reference to a preferred embodiment thereof, it is to be understood that modifications or variation may be easily made without departing from the spirit of this invention which is defined by the appended claims.

What is claimed is:

1. In a horizontal form-fill-seal packaging machine including a former for forming a film supplied from a film source into a tubular configuration with lapped side edges extending in a longitudinal direction of the film, conveyor means for conveying articles to be packaged and for feeding articles into the tubular film one after another, a fin sealer for sealing the lapped edges of the tubular film in the longitudinal direction with the articles positioned within the tubular film;

an end sealer for sealing the tubular film in a crosswise direction thereof in a position between two adjacent articles, and film feeding means for feeding the film supplied from said film source into said end sealer via said former and said fin sealer; the improvement comprising:

a plurality of pushers mounted on said conveyor means and equi-distantly spaced from each other in the feeding direction of the articles, each of said pushers defining the position of a rear end of the article opposite to the feeding direction of the article;

length detecting means for sequentially detecting the length in the feeding direction of the articles conveyed by said conveyor means; and control means for controlling said conveyor means and said end sealer in response to the length of each article detected by said length detecting means, said control means controlling the speed of said conveyor means such that an equi-distant space is formed between each two adjacent articles, and controlling the operation timing of said end sealer such that the end sealer seals the tubular film in substantially the central position of said space between two adjacent articles.

2. The machine as defined in claim 1 wherein said detecting means is operable to detect the position of the forward end of each of the articles on said conveyor means.

3. The machine as defined in claim 1 wherein said control means normally controls the speed of said conveyor means, the feeding speed of said film feeding means and the operation timing of said end sealer to a first reference speed, a second reference speed and a reference timing, respectively, for packaging a reference number per hour of articles having a reference length; and wherein said control means controls the speed of said conveyor means and the operation timing of said end sealer to be varied from said first reference speed and said reference timing, respectively, in response to the difference between the detected length of each article and the reference length.

4. The machine as defined in claim 3 wherein said control means holds the speed of said conveyor means at said first reference speed and reduces the driving speed of said film feeding means and said end sealer so as to stop the same for preventing production of an empty package when no article has been detected between two adjacent pushers.

5. The machine as defined in claim 1 wherein said end sealer is rotatably driven, so that the control of the operation timing of said end sealer is performed on the basis of speed varying control of the rotational speed.

6. The machine as defined in claim 1 wherein said conveyor means, said end sealer and said film feeding mechanism include driving mechanisms independently driven of each other, and each of said driving mechanisms includes a motor.

7. The machine as defined in claim 6 wherein among said motors of said conveyor means, said end sealer and said film feeding means, at least said motors of said conveyor means and said end sealer are servo motors, and said control means performs speed varying control of said servo motors.

8. The machine as defined in claim 7 wherein a first encoder and a second encoder are associated with said servo motors of said conveyer means and said end sealer, respectively, and each of said first and second encoders outputs pulse signals representing the rotational position and the, rotational speed of their corresponding servo motor to said control means.

9. The machine as defined in claim 8 wherein said motor of said film feeding means is a servo motor, and a third encoder is associated with said servo motor of said film feeding means for outputting pulse signals representative of the film feeding speed and the film position to said control means.

10. The machine as defined in claim 6 further including pusher position detecting means and end sealer position detecting means, said pusher position detecting means being operable to detect the current position of each of said pushers, said end sealer position detecting means being operable to detect an origin position which is a reference position of rotation of said end sealer, and said control means receiving detecting signals from said pusher position detecting means and end sealer position detecting means as well as a detecting signal from said length detecting means.

11. The machine as defined in claim 10, wherein said control means outputs control signals to said motors of said conveyor means, said end sealer and said film feeding means based on said detecting signals from said length detecting means, said pusher position detecting means and said end sealer position detecting means.

12. A method of controlling a horizontal form-fill-seal packaging machine including a former for forming a film supplied from a film source into a tubular configuration with lapped side edges extending in a longitudinal direction of the film, conveyor means for conveying articles to be packaged and for feeding articles into the tubular film one after another, a fin sealer for sealing the lapped edges of the tubular film in the longitudinal direction with the articles positioned within the tubular film, a end sealer for sealing the tubular film in a crosswise direction thereof in a position between two adjacent articles, and film feeding means for feeding the film supplied from said film source into said end sealer via said former and said fin sealer, comprising the steps of:

a) sequentially detecting the length in the feeding direction of the articles conveyed by said conveyor means;

b) controlling the speed of said conveyor means such that an equi-distant space is formed between each two adjacent articles; and c) controlling the operation timing of said end sealer such that said end sealer seals the tubular film in substantially the central position of said space between two adjacent articles.

13. The method as defined in claim 12 further including the step of normally controlling the speed of said conveyor means, the feeding speed of said film feeding means and the operation timing of said end sealer to a first reference speed, a second reference speed and a reference timing, respectively, for packaging a reference number per hour of articles having a reference length, and wherein the steps b) and c) are performed to vary the speed of said conveyor means and the operation timing of said end sealer from said first reference speed and said reference timing, respectively, in response to the difference between the detected length of each article and the reference length.

14. The method as defined in claim 13 further including the step of holding the speed of said conveyor means at said first reference speed, and reducing the feeding speed of said film feeding means and the driving speed of said end sealer so as to stop the same for preventing production of an empty package when no article has been detected between two adjacent pushers.

* * * * *